United States Patent [19]

Dawidowitch

[11] Patent Number: 4,578,565

[45] Date of Patent: Mar. 25, 1986

[54] COMBINED ELECTRIC HEATING AND WATER INLET/OUTLET ASSEMBLY FOR WATER HEATING TANKS

[76] Inventor: Shmuel Dawidowitch, 304 Hayarkon St., Tel Aviv, Israel

[21] Appl. No.: 678,460

[22] Filed: Dec. 5, 1984

[30] Foreign Application Priority Data

Dec. 7, 1983 [IL] Israel ..... 70402

[51] Int. Cl.[4] ..... H05B 1/02; H05B 3/82

[52] U.S. Cl. ..... 219/314; 122/13 A; 126/351; 126/362; 219/306; 219/316; 219/331

[58] Field of Search ..... 219/310, 312, 314, 316, 219/318, 319–321, 335, 336, 306; 126/362, 361, 351; 122/13 A

[56] References Cited

U.S. PATENT DOCUMENTS

| | | | |
|---|---|---|---|
| 4,403,137 | 9/1983 | Glazer | 219/314 X |
| 4,514,617 | 4/1985 | Amit | 219/314 |

FOREIGN PATENT DOCUMENTS

| | | | |
|---|---|---|---|
| 153147 | 4/1951 | Australia | 219/314 |
| 132031 | 8/1978 | German Democratic Rep. | 219/314 |
| 694294 | 9/1965 | Italy | 219/314 |
| 46314 | 9/1939 | Netherlands | 219/314 |
| 498977 | 1/1939 | United Kingdom | 219/312 |
| 513820 | 10/1939 | United Kingdom | 219/314 |

*Primary Examiner*—A. Bartis

*Attorney, Agent, or Firm*—Ostrolenk, Faber, Gerb & Soffen

[57] ABSTRACT

A combined heating and water inlet/outlet assembly for installation in a bottom opening of a domestic water heater tank includes a plastic mounting flange adapted to cover the opening and a plastic open-top cylindrical sleeve extending upwardly therefrom and adapted to project into the tank through the opening. An electric immersion heating element is removably carried by the flange and projects into the sleeve. Integrally formed water inlet and outlet tubes extend along the outer generatixes of the sleeve. A second, plastic, closed-top cylindrical unit is received on top of the sleeve to form an extension of thereof. An integral tubular section along the outer surface of the cylindrical member forms an extension of the outlet conduit. The closed top of the cylindrical member has an integral upwardly extending riser tube forming an outlet for water heated by the heating element. A series of integrally formed pairs of parallel plastic tube lengths fit one on top of the other and on top of the tubular outlet and riser tube section to form extensions thereof up to the top wall of the tank. A valved opening is provided in the cylindrical member for introducing water thereinto from the tank and permitting shutting off the water flow into the cylindrical member for replacing the heating element without need to empty the whole tank.

9 Claims, 8 Drawing Figures

FIG. 3
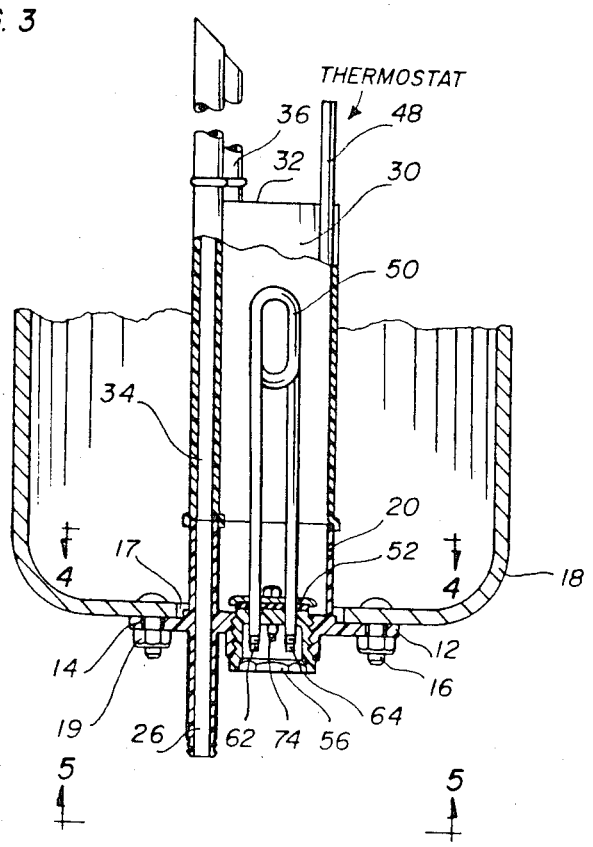
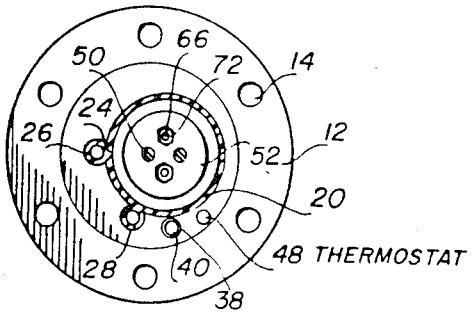
FIG. 4
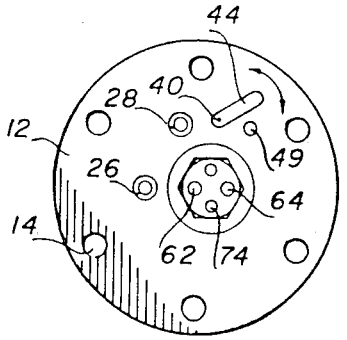
FIG. 5

FIG. 6
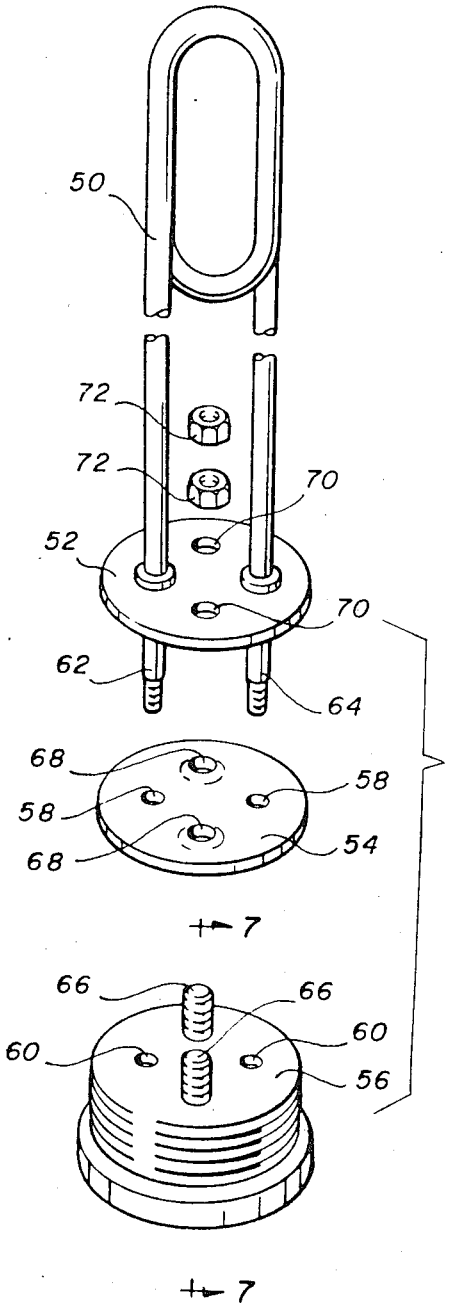
FIG. 7
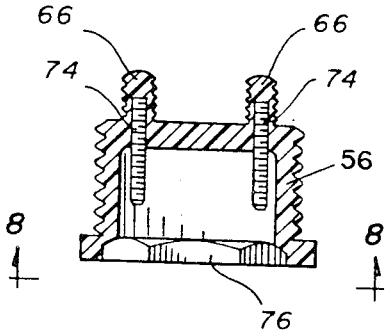
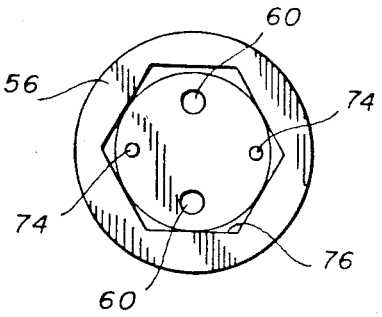
FIG. 8

COMBINED ELECTRIC HEATING AND WATER INLET/OUTLET ASSEMBLY FOR WATER HEATING TANKS

The present invention relates to electric water heaters of the domestic type included in apartments or as back-up heated water source comprised in solar heating systems.

Following recent developments in this field, water heaters are frequently equipped with an arrangement designed to more intensively concentrate the heating energy to water located at the upper region of the tank (e.g. U.S. Pat. No. 4,403,137). These installations usually comprise a chimney-like tube which includes an immersion-type electric element whereby the water heated within the tube is forced to rise and first accummulate at the upper region of the tank, rather than to heat the whole body of water according to previous conventional designs. This development has initiated a great demand to replacement units which are readily adapted to be substituted within existing tanks of the old design.

The invention therefore proposes most convenient, compact and easy to install—even as a "do it yourself" job—such water heating replacement units.

Moreover, due to the use of immersion-type electric elements, rather than enclosed heating elements, a more serious problem of such elements becoming clogged by scale and sediments is presented, which significantly reduced their efficiency and even caused their frequent burning-out. Therefore, the invention also provides a convenient solution to the problem of electric element replacement which enables even the unskilled holder to replace the element himself without use of special tools and workmanship.

According to a still further advantageous feature of the invention, there are provided means allowing such electric element replacement operations be carried out without need first to empty to whole contents of the water tank.

For further cutting down the manufacturing costs of the assembly provided according to the invention, its main units are readily made of plastic by a conventional injection molding process.

Furthermore, the said assembled structure lends itself to fit any required tank height, using a set of extention tubes to be supplied in a kit form.

It is therefore provided according to the invention a combined heating and water inlet/outlet assembly for domestic electric water heater tanks, having a circular bottom opening surrounded by a series of gudgeon bolts for fastening thereto an electric element mounting flange. The assembly comprises a first, integrally formed unit having a circular flange adapted to cover the tank opening and fastened thereto by the gudgeons. An open-top cylindrical sleeve extends upwardly from a central section of the flange, projecting to the interior of the tank. A tapped opening in the central portion of the flange threadably receives a plug member carrying an electric immersion-type heating element which extends upwardly into the sleeve with its terminals projecting downwards. A pair of tubular conduits form the water inlet and outlet of the tank, extend from the flange each along an outer generatrix of the sleeve, and downwards of the flange, for connecting thereto cold and heated water conduits. A second, integrally formed unit comprises a closed top cylindrical member seated on top of the sleeve to form an extension thereof. A tubular section extends along an outer generatrix of the cylindrical member, thus forming an extension of the outlet conduit. An upwardly extending riser tube section is provided at the closed top of the cylindrical member, forming an outlet for water heated by the heating element. A series of integrally formed pairs of parallel tube lengths fit one on top of the other and on top of the tubular outlet and the riser tube section, to form extensions thereof up to the top wall of the tank. An opening at the wall of the cylindrical member is made for introducing water thereinto from the interior of the tank.

These and further aspects and advantages of the invention will become more fully appreciated in the light of the following description, given by way of example only, of a preferred embodiment of the invention, with reference to the accompanying drawings, wherein:

FIG. 3 shows in more detail the mounting of the assembly;

FIG. 4 is a view taken along lines 4—4 of FIG. 3;

FIG. 5 is a view taken along lines 5—5 of FIG. 3;

FIG. 6 is an exploded view of the electric element and its mounting parts and components;

FIG. 7 is a section taken along lines 7—7 of FIG. 6; and

FIG. 8 is a bottom view taken along lines 8—8 of FIG. 7.

Figure 1:
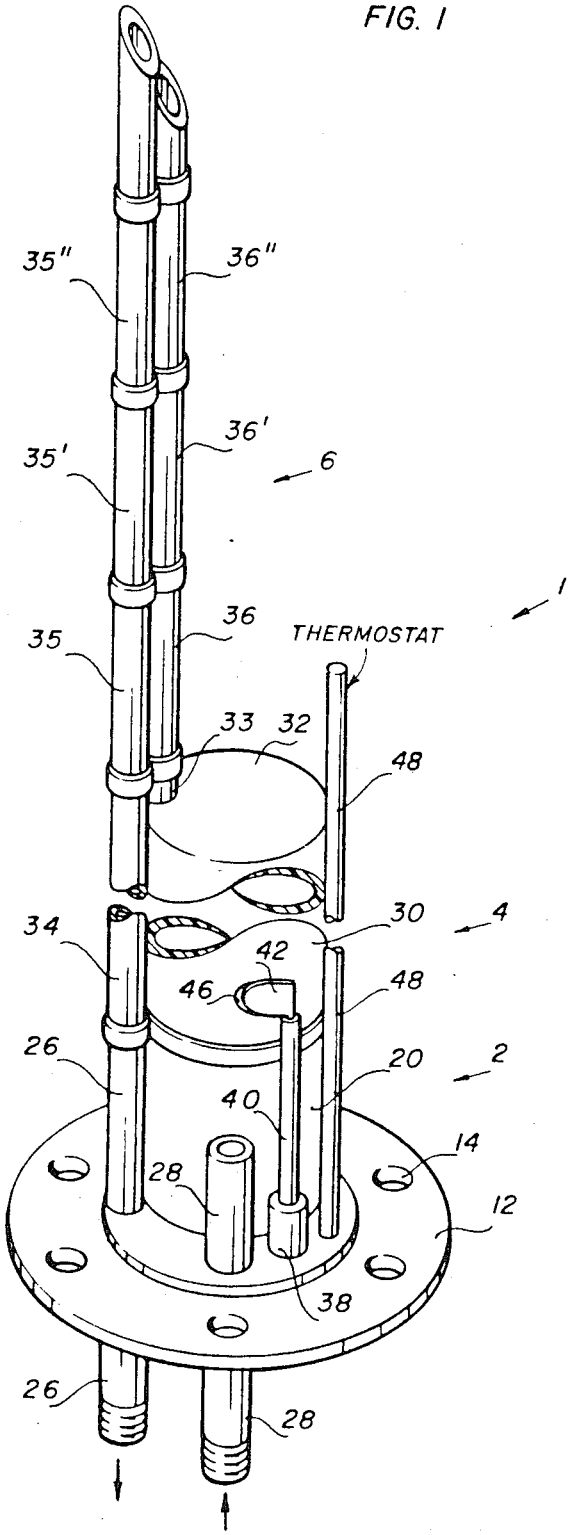
FIG. 1 is a general, schematic, three-dimensional view of the assembly according to the invention.

As generally shown in FIG. 1, the inlet/outlet/electric heater assembly, is comprised of three main parts, namely a first, bottom unit 2, a second, top unit 4 and an extension double-tube member 6.

Referring to the unit 2, it is integrally formed, preferably by plastic injection molding, and comprises the following main portions: A flange 12 of the standard measures and type, namely, comprising openings 14 designed to become received by gudgeons 16 conventionally comprised around an opening 17 at the bottom of jacket 18 of the water tank and adapted to be tightened thereto by nuts 19 (see FIGS. 2 and 3); a sleeve-like, open top cylinder 20 extending from the central region of the flange 12, to a certain height thereabove; and outlet tube 26, joined to the sleeve 20 by a common wall portion 24 along a generatix thereof (FIG. 4) and extending downwards through the flange 12 a certain distance therebelow where it is adapted to be connected to the hot water consuming installation; and a likewise joined inlet tube 28 extending parallel to the tube 26 at both sides of the flange 12, forming the inlet or the water tank 18.

Sleeve 20 and inlet tube 26 are extended by a complementary, integrally formed top unit 4, snugly fit thereon, as shown. It comprises a cylinder 30 with a closed top 32, provided, however, with an opening extended by a riser tube section 33. Joined to an outer generatrix of the cylinder 30 is an outlet tube extension 34.

The double-tube member 6 comprises a series of joined tube pairs 35 and 36, 35' and 36', 35'' and 36'', and so forth if necessary, snugly received one on top of the other, rising from the level of the cylinder top 32 up to the top of the tank jacket 18. This arrangement allows the building-up of the tubes as dictated by the inner height of the tank jacket 18 into which the assembly is to be installed.

Referring back to the bottom unit 2, there is further provided an integrally formed bushing 38 for rotatably supporting a swingable valve comprised of a rod 40 carrying a valve closure member 42. The downwardly extended portion of the rod 40 is provided with a handle 44 (FIG. 5) for rotatably manipulating the valve closure 42 into a sealing contact with an opening 46 provided in the wall of the cylinder 30. Opening 46 provides communication between the interior of the assembly 1 and the body of water within the tank.

Finally, the bottom unit 2 carries a thermostat housing 48 mounted in a tapped bore 49 prepared in the flange 12 during the injection molding thereof.

Mounting of an electric heating element 50 is accomplished in the following manner—see FIGS. 6–8. Element 50 with its associated mounting disc 52 and rubber gasket disc 54 is attached, to a threaded, plastic molded plug 56. Openings 58 at the gasket 54, and 60 at the top wall of the plug 56, are made for the passage of the element's terminals 62 and 64. A pair of gudgeons 66 are integrally made with the plug 56, and passed through openings 68 and 70 of the rubber gasket 54 and the mounting disc 52, respectively, to be fastened by nuts 72.

As more clearly shown in FIG. 7, there are further provided a pair of fixed, insulated electrical terminals in the form of metal threaded pins 74, embedded in the material of the plug 56 and projecting into in inner space of the plug, as shown. Finally, an inner polygonal contour 76 is formed at the bottom of the plug 56 for tightening of the threaded plug by a suitable tool.

Figure 2:
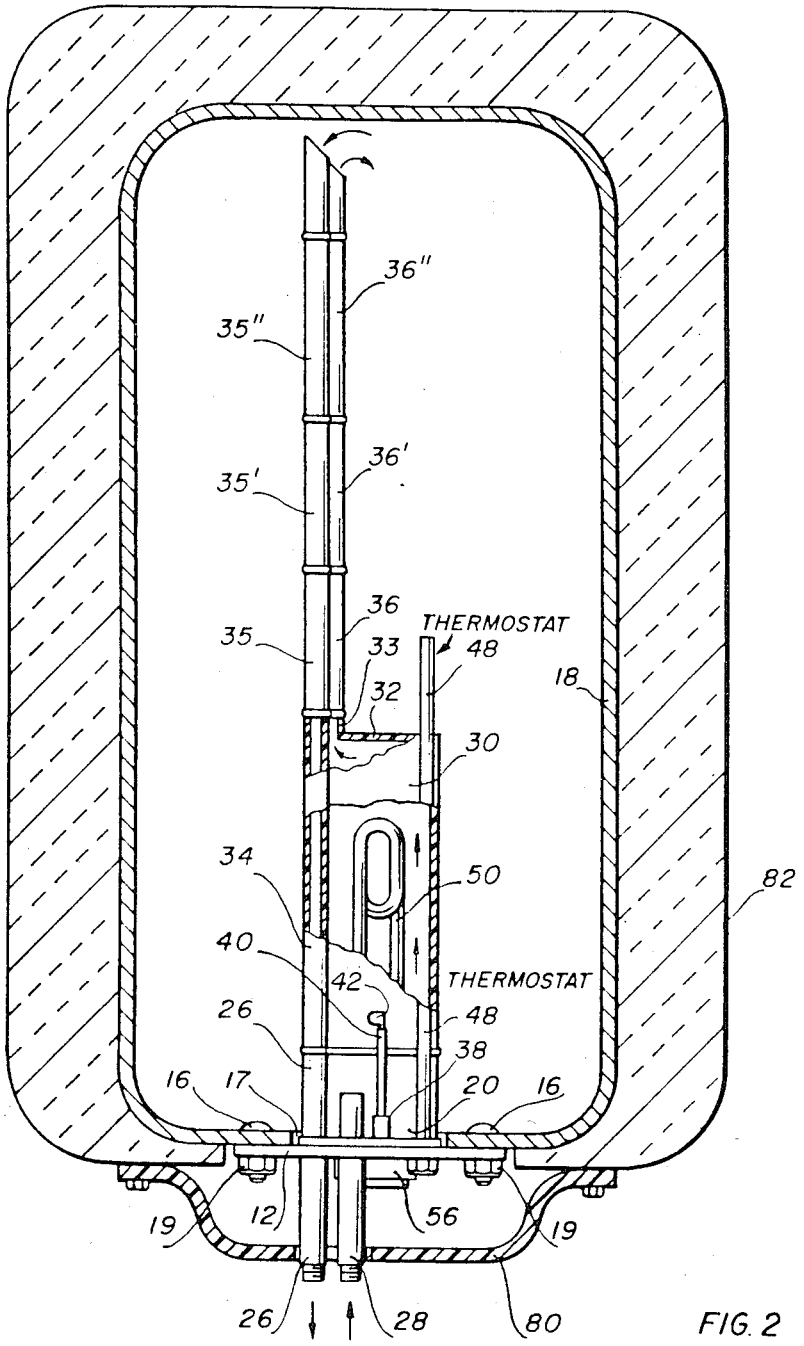
FIG. 2 is a longitudinal cross-sectional view of a water tank provided with the assembly of FIG. 1.

A dished cover 80 is connected to outer shell 82 of the tank to complete its structure—FIG. 2.

It will be now readily appreciated from the foregoing description that the assembly, namely the bottom unit 2 with cover cylinder 30 and a set of risers 35–36, supplied ex-factory, is readily adaptable for installment either in newly-produced water tanks or as a replacement for the old element housings in existing water heaters. All that is needed is to unscrew the gudgeon nuts of the old flange and substitute same by flange 12 with its associated parts, and reconnecting the water inlet and outlet tubes 28 and 26. Furthermore, should the electric element 50 become burnt-out, it can readily be replaced by unscrewing the plug 56 using a wrench or other tool agaist the polygonal surface 76. In order to facilitate such replacements without need to empty the whole tank, mainpulatable valve should be first turned off, namely, by rotating the handle 44 (from outside the tank at the bottom of the flange 12) to bring the valve closure 42 into sealing engagement with the opening 46 at the cylinder 30. This will stop the water flow from the surrounding area of the tank into the sleeve 20 and cylinder 30 which enclose the element 50, thereby allowing but a small quantity of water to flow out from the tank when plug 56 is dismounted, only to bring the level of water down to the top of the riser 36.

Hence, the invention accomplishes most effectively the object of providing a neat, compact, and ready-to-use replacing and/or originally installed quick heating water inlet/outlet units, thereby drastically cutting down the costs of such replacements.

Those skilled in the art will readily appreciate that various changes, modifications and variations are applicable to the preferred embodiment of the invention as heretofore described without departing from the scope thereof as defined in and by the appended claims.

What is claimed is:

1. A combined heating and water inlet/outlet assembly for domestic electric water heater tanks having a circular bottom opening surrounded by a series of gudgeon bolts for fastening thereto an electric element mounting flange, comprising (a) a first, integrally formed unit having a circular flange adapted to cover the tank opening and provided with circumferentially spaced openings adapted to receive the tank gudgeons;

(b) an open-top cylindrical sleeve having its bottom closed by and extending upwardly from a central section of the flange, which sleeve is adapted to be inserted through the tank opening into the interior of the tank;

(c) a tapped opening in said central portion threadably receiving a plug member carrying an electric immersion-type heating element extending upwardly into said sleeve with its terminals projecting downwards;

(d) a pair of tubular conduits, adapted to form the water inlet and outlet of the tank, extending upwardly from the said flange each along an outer generatrix of the said sleeve, and downwards of the flange, for connecting thereto cold and heated water conduits;

(e) a second, integrally formed unit comprising a closed top cylindrical member seated on top of the said sleeve to form an extension thereof;

(f) a tubular section extending along an outer generatrix of the cylindrical member thus forming an extension of said outlet conduit;

(g) an upwardly extending riser tube section at the closed top of the cylindrical member, forming an outlet for water heated by said heating element;

(h) a series of integrally formed pairs of parallel tube lengths fitting one on top of the other and on top of said tubular outlet and said riser tube section, to form extensions thereof up to the top wall of the tank; and (i) an opening at the wall of the cylindrical member for introducing water thereinto from the interior of the tank.

2. The assembly as claimed in claim 1, further comprising a valve for selectively closing said water introducing opening.

3. The assembly as claimed in claim 2, wherein said valve is operated by a manipulatable member extending downwards of the flange.

4. The assembly as claimed in claim 3, wherein a thermostat is mounted on the flange, adjacent the sleeve.

5. The assembly as claimed in claim 1, wherein the plug is provided with two integrally-formed gudgeons mounting the electric element thereon.

6. The assembly as claimed in claim 5, wherein a pair of threaded pins are embedded in the plug, projecting from the bottom side thereof.

7. The assembly as claimed in claim 1 wherein the first unit is integrally formed by plastic injection molding.

8. The assembly as claimed in claim 1 wherein the second unit is integrally formed by plastic injection molding.

9. The assembly as claimed in claim 1 wherein the tube pairs of said series are integrally formed by plastic injection molding.

* * * * *